US006467095B1

(12) United States Patent
Nunnery

(10) Patent No.: US 6,467,095 B1
(45) Date of Patent: Oct. 22, 2002

(54) PERSPIRATION-ABSORBING BAND FOR HEADGEAR

(76) Inventor: Merle Nunnery, 602 Franklin, Gretna, LA (US) 70053

( * ) Notice: Subject to any disclaimer, the term of this patent is extended or adjusted under 35 U.S.C. 154(b) by 0 days.

(21) Appl. No.: 09/918,215

(22) Filed: Jul. 30, 2001

(51) Int. Cl.[7] ..... A42C 5/00
(52) U.S. Cl. ..... 2/181.6; 2/181; 2/DIG. 11
(58) Field of Search ..... 2/209.13, 181, 2/181.6, 410, 414, 171, DIG. 11

(56) References Cited

U.S. PATENT DOCUMENTS 1,498,505 A * 6/1924 Buchanan ..... 2/181
4,468,817 A * 9/1984 Nunnery et al. ..... 2/181
RE33,430 E * 11/1990 Nunnery et al. ..... 2/181
5,265,279 A * 11/1993 Mathiis ..... 2/181
6,138,280 A * 10/2000 Bae ..... 2/181

* cited by examiner

*Primary Examiner*—Gloria M. Hale
*Assistant Examiner*—Tejash Patel
(74) *Attorney, Agent, or Firm*—Keaty Professional Law Corporation

(57) ABSTRACT

A perspiration band and a method of making thereof is disclosed. The perspiration band formed from a moisture-absorbing fabric and is provided with a pair of notches that allow the band to be secured by fasteners on a headband on a headgear. The outwardly flaring end portions extend the reach of the band along the headband. A plurality of non-aligned fasteners attached along the sides of the band facilitate creation of an excess of material on the portion of the band that contact the user's head, thus increasing moisture-absorbing capabilities of the perspiration band.

22 Claims, 2 Drawing Sheets

PERSPIRATION-ABSORBING BAND FOR HEADGEAR

BACKGROUND OF INVENTION

This invention relates to articles attachable to headgear, and more particularly to a band for absorbing perspiration of the user when the headgear is worn.

Many technologies and industrial fields require workers to wear special headgear, such as hard hats or welding shields at all times while they are in the industrial facility. The hard hats are conventionally provided with a flexible, non-absorbing band that encircles the interior wall of the hard hat and helps the user to adjust the hat size to fit the user.

The headgear band, being made from a non-absorbing plastic tends to adhere to the forehead of the user, where perspiration is likely to accumulate, and cause unpleasant sensations, and in some extreme cases—allergic reactions. The headbands are usually comprised of a circular band that contacts the head of the user and a plurality of upwardly extending portions connected together in the apex of the headgear.

One of the solutions to help absorb perspiration of the wearer is disclosed in our earlier patent No. Re. 33,430 issued on Nov. 13, 1990. In that patent, the perspiration band made from a moisture absorbing material is provided with a plurality of snaps along opposite elongated ends thereof to be placed around the headband of the hard hat and be secured thereon in the area where the forehead is likely to contact the band. The perspiration band is made from moisture-absorbing material and is easily detachable for washing and cleaning when required.

While the perspiration band in accordance with patent No. Re. 33,430 works satisfactorily in many cases, it has been observed that a relatively rectangular structure of the perspiration band may not be beneficial in all hard hat applications. The present invention contemplates provision of an improved perspiration band that would provide greater moisture absorbing capabilities and, at the same time, be suitable for a wider variety of headgear applications.

SUMMARY OF THE INVENTION

It is, therefore, an object of the present invention to provide a moisture-absorbing perspiration band that can be used with a wide variety of headgear.

It is another object of the present invention to provide a moisture-absorbing perspiration band that is easily positionable and removable from the headgear for regular cleaning and washing.

It is a further object of the present invention to provide an improved moisture-absorbing perspiration band with increased moisture-absorbing capabilities.

It is still a further object of the present invention is to provide a moisture-absorbing perspiration band which is easy to use and inexpensive to manufacture.

These and other objects of the present invention are achieved through a provision of a perspiration band that is formed from a moisture-absorbing material, for instance terry cloth fabric. The perspiration band has a first side provided with a plurality of V-shaped notches and a second continuous side. A pair of end portions connects the first side to the second side, the end portions extending at an obtuse angle in relation to the second side.

The band carries a plurality of securing members, such as snap fasteners, that have securing elements facing one surface of the perspiration band. When the perspiration band is secured on a headband of the headgear, the fasteners appear above the band and may be secured together to attach the perspiration band to the headband.

The fasteners are attached along the first side and along the continuous second side of the band in a generally non-aligned relationship. When the fasteners are secured together an excess of fabric is created on the inner portion of the headband, where the head of the user contacts the perspiration band. This excess of material increases moisture-absorbing capabilities of the perspiration band.

BRIEF DESCRIPTION OF THE DRAWINGS

Reference will now be made to the drawings, wherein like parts are designated by like numerals, and wherein.

Figure 1:
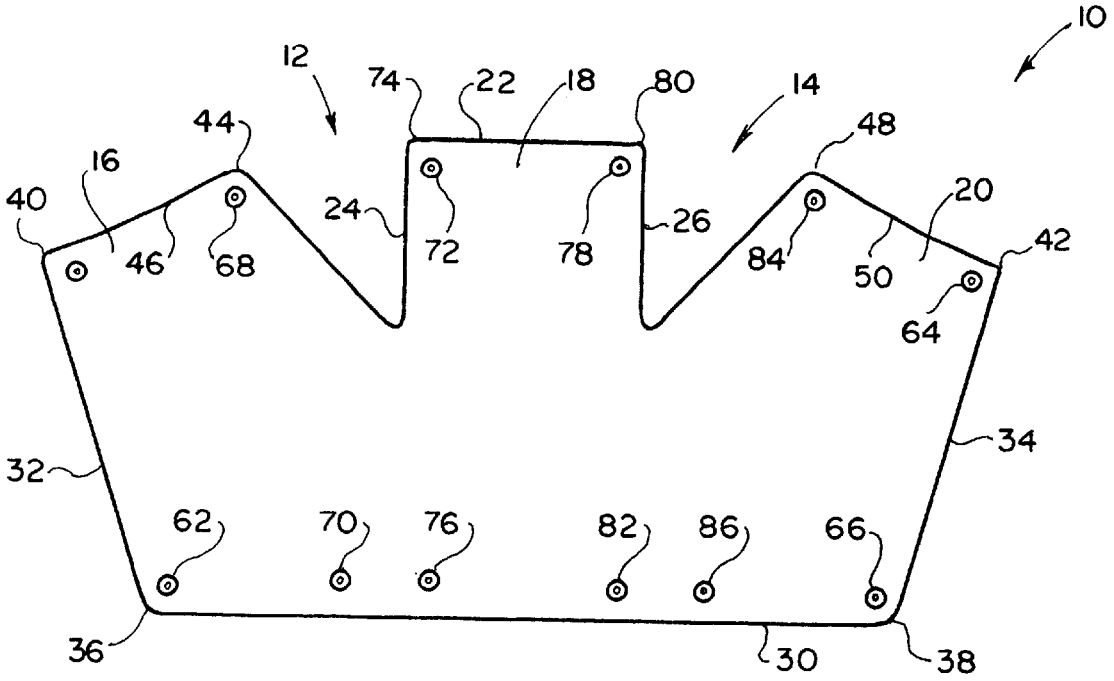
FIG. 1 is a plan view of the perspiration band in accordance with the present invention.

Turning now to the drawings in more detail, numeral 10 designates the moisture-absorbing perspiration band of the present invention in its finished condition. As can be seen in the drawing, the band 10 has an irregular shape with a pair of generally V-shaped notches 12 and 14. For the purposes of this description, the side of the band 10 wherein the notches 12 and 14 are formed will be referred to as the first side. The notches 12 and 14 form a first side tab 16, a central tab 18, and a second side tab 20. The tabs 16 and 20 are mirror images of each other, while the tab 18 is formed in the center of the band 10 and is defined by a curved edge 22 and cut out sides 24 and 26.

The band 10 has a second continuous side 30 connected to the first side by end portions 32 and 34. The end portions 32 and 34 are each oriented at an obtuse angle in relation to the second side 30, flaring outwardly from corners 36, 38 of the side 30 to corners 40 and 42, respectively of the first side. The corner 40 is connected to a corner 44 by a tab side 46, and corner 42 is connected to a corner 48 by a tab side 50.

The perspiration band 10 is provided with a plurality of securing members attached along the first side and the second side. The securing members may be snaps or such similar devices. The securing members of the first side are positioned in a generally non-aligned position in relation to securing members of the second side, as will be described in more detail below.

A snap 60 secured in the corner 40 has an opposing mating snap 62 positioned in the corner 36. A snap 64 positioned in the corner 42 has an opposing mating snap 66 secured in the corner 38. A snap 68 positioned in the corner 44 has an opposing mating snap 70 located along the side 30, not in alignment with the snap 68. A snap 72 positioned in a corner 74 of the tab 18 has an opposing mating snap 76 located along the side 30 in approximate alignment with the snap 72. A snap 78 is located in a corner 80 of the central tab 18 in approximate alignment with a snap 82 positioned along the side 30. A snap 84 located in a corner 48 of the tab

20 has an opposing mating snap 86 located out of alignment with a snap 84 along the side 30.

Figure 2:
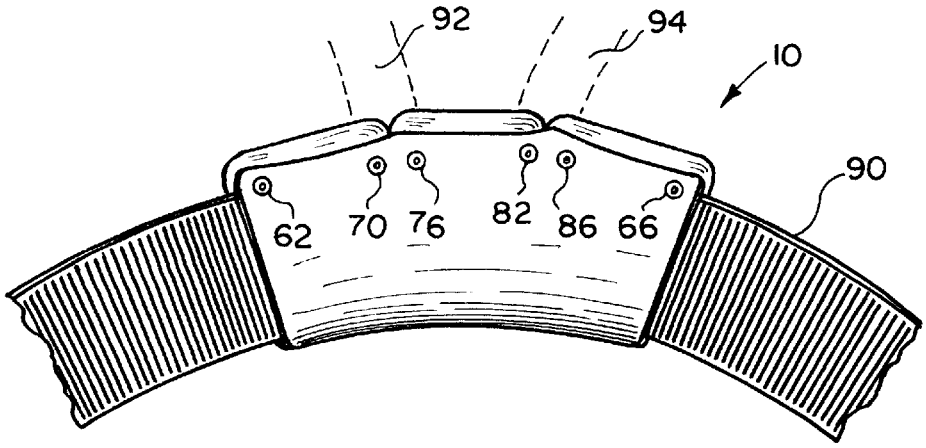
FIG. 2 is a detail view showing positioning of the perspiration band on the headgear portion.

Turning now to FIG. 2, the manner of positioning the band on the headgear is illustrated in more detail. When positioning the perspiration band 10, the user folds the band 10 such that the tabs 16, 18, and 20 are on the outside portion of a plastic band 90 of a hardhat (not shown). The notches 12 and 14 facilitate positioning of the band 10 around connecting strips 92 and 94 which form a part of the headgear headband. The snaps of the band 10 are located above the band 90 and can be secured together, as shown in FIG. 2 by forcing the mating snaps together.

The snap 62 is mated with the snap 60, the snap 70 is fastened with the snap 68, the snap 76 is secured to the snap 72, the snap 82 is secured with the snap 78, the snap 86 is secured with the snap 84, and the snap 66 is attached to the snap 64. Since the distance between the snaps 62 and 70 is greater than the distance between the snaps 60 and 68, the portion of the side 30 between the snaps 62 and 70 tends to slightly bulge and form a fold when the band 10 is positioned on the head of the user with a headgear. The same result is achieved in the opposite end of the band 10.

The distance between the snaps 84 and 64 is slightly smaller than the distance between the snaps 86 and 66. Consequently, when the snaps 84 and 64 are joined with snaps 86 and 66, respectively, a small bulge is formed in the side 30 which will translate into a fold or extra amount of moisture absorbing material when the headband is worn by the user. The extra material helps absorb more moisture when worn by the user and the flare out end portions 32 and 34 help cover a greater portion of the user's forehead where perspiration tends to accumulate.

The notches 12 and 14 are made deeper in comparison with the prior designs to accommodate the strips 92 and 94 of the band 90. In this manner, the perspiration band 10 becomes more versatile for use with different types of headgear, such as hardhats, welding shields, and the like. The headband 10 is easily disengageable from the plastic band 90 by forcing the snaps apart and removing the band 10 for washing. The snaps do not interfere with regular washing and cleaning of the perspiration band 10 that may be used many times without damage.

The perspiration band 10 is made from a highly moisture-absorbing material, for instance, terrycloth fabric. Of course, other porous, moisture-absorbing material or fabric may be used if desired.

Figure 4:
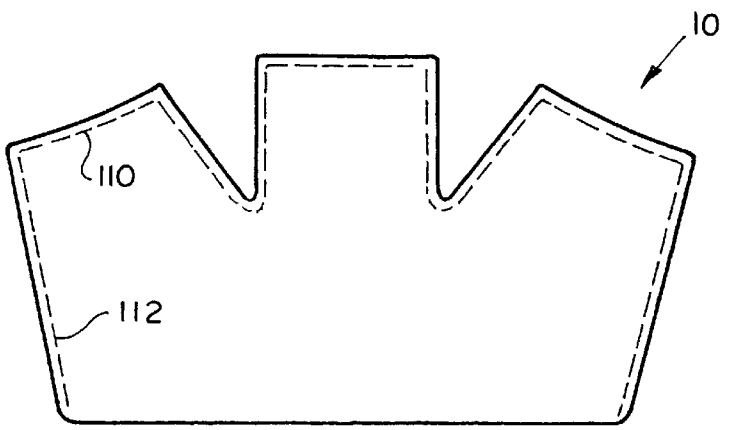
FIG. 4 illustrates the second step in the manufacturing process of the perspiration band in accordance with the present invention.
Figure 5:
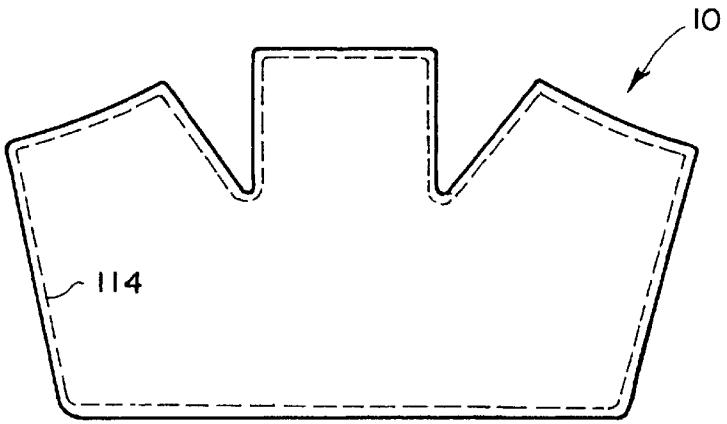
FIG. 5 illustrates the third step in the manufacturing process of the perspiration band in accordance with the present invention.
Figure 3:
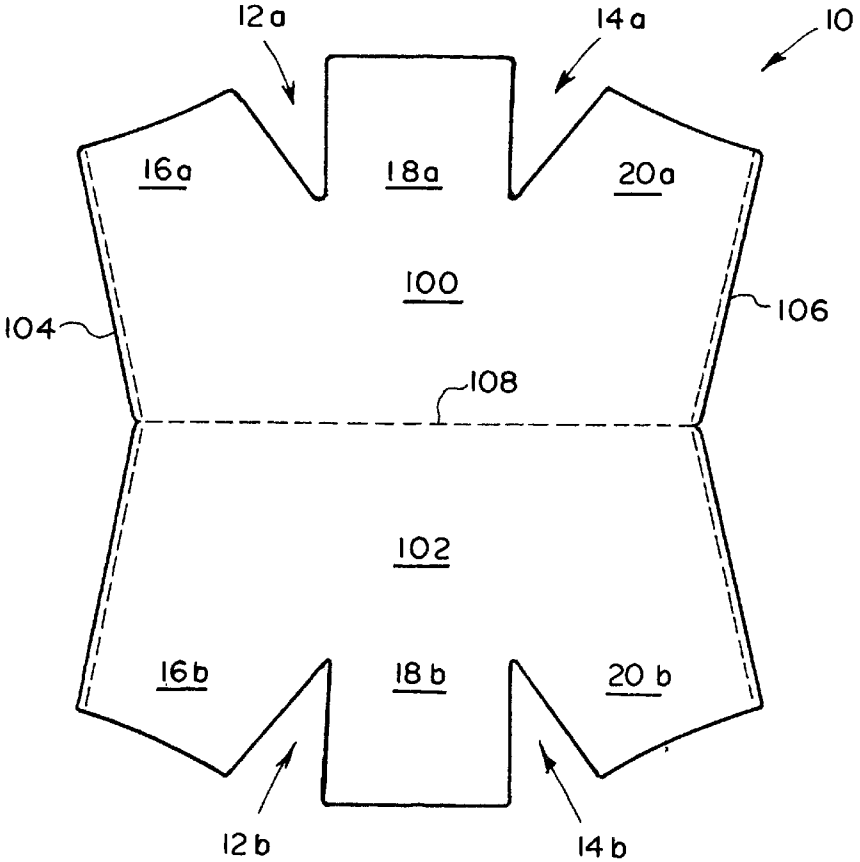
FIG. 3 is a plan view of the first step in the manufacturing of the perspiration band in accordance with the present invention.

Turning now to FIGS. 3–5, the method of manufacturing the perspiration band 10 will be described in more detail. The process of manufacturing starts with cutting out the band from a piece of fabric. This first step can be seen in FIG. 3. The cutout piece consists of two mirror image portions 100 and 102, each provided with notches 12*a*, 14*a*, and 12*b*, 14*b*, respectively. The operator folds the ends 104 and 106 to form a hem and stitches along the end lines.

The portions 100 and 102 are then folded along the center line 108, such that the inner face of the first side tab 16*a* joins with an inner side of the first side tab 16*b*, the inner side of the central tab 18*a* meets with the inner side of the central tab 18*b*, and the inner side of the second side tab 20*a* meets with the inner side of the second side tab 20*b*. Once the portions 100 and 102 are folded together, the perspiration band 40 can be secured along the first side and around the edges by a stitch seam 110 (FIG. 4). At that time, the hemmed portions 104 and 106 are secured together with a stitch 112.

The perspiration band 10 is then turned inside out, and the user pushes out the corners 40, 44, 74, 80, 48, 42, 38, and 36. Following this step, a second hemming of the perspiration band 10 is made, as shown in FIG. 5, along the entire periphery of the band 10 by a stitch 114.

Finally, the snaps 60, 68, 72, 78, 84, 64, 66, 86, 82, 76, 70, and 62 are attached in a conventional manner to the corners of the perspiration band 10 and of the tabs 16, 18, and 20. The perspiration band 10 assumes the finished condition shown in in plan view in FIG. 1.

It is envisioned that the perspiration band 10 may be impregnated with antibacterial solutions or moisturizing creams to prevent irritation to the skin of the user, especially if the perspiration band 10 is to be worn in hot climates. Some of the stitching may be done with a zigzag stitch to facilitate some stretching of the headband without tearing it as might happen with straight stitching. For instance, the hemming of the end portions 104 and 106 may be done with a zigzag stitch.

Many changes and modifications can be made in the design of the present invention without departing from the spirit thereof. We, therefore, pray that our rights to the present invention be limited only by the scope of the appended claims.

I claim:

1. A perspiration band for headgear, comprising:

a flexible body formed from moisture-absorbing material, said body having a first side, a second side and opposing end portions connecting the first side and the second side, said first side being provided with a pair of cutouts dividing the first side into a plurality of tabs, and wherein said end portions are integrally connected at an obtuse angle in relation to said second side, said first side having a longitudinal dimension substantially greater than a longitudinal dimension of the second side so as to form moisture-absorbing folds in said first side when said perspiration band is positioned on said headgear; and a plurality of securing members attached along said first side and said second side, said securing members being fastened together when said flexible body is positioned on a headband of the headgear.

2. The device of claim 1, wherein said plurality of tabs comprises a first side tab, a central two tab and a second side tab.

3. The device of claim 2, wherein a securing member is attached in each corner of said first en side tab, said central tab and said second side tab.

4. The device of claim 1, wherein said cutouts have a generally V-shaped configuration.

5. The device of claim 1, wherein said securing members are snaps provided with mating engaging fastener elements facing one face of the body.

6. A perspiration band for headgear, comprising:

a flexible body formed from moisture-absorbing material, said body having a first side, a second side and opposing end portions connecting the first side and the second side, said first side being provided with a pair of cutouts dividing the first side into a plurality of tabs, and wherein said end portions are integrally connected at an obtuse angle in relation to said second side, said first side having a longitudinal dimension substantially greater than a longitudinal dimension of the second side so as to form moisture-absorbing folds in said first side when said perspiration band is positioned on said headgear, said plurality of tabs comprising a first side tab, a central tab and a second side tab; and a plurality of securing members attached along said first side and said second side, said securing members being fastened together when said flexible body is positioned on a headband of the headgear, said securing member being attached in each corner of said first side tab, said central tab and said second side tab, and wherein securing members positioned along the first side of the central tab have generally aligned mating securing members positioned along the second side, and wherein securing members of the first side tab and the second side tab are non-aligned in relation to mating securing members secured along the second side of the body.

7. The device of claim 6, wherein an excess of material is formed along the second side when said securing members are fastened together on the headband of the headgear, said excess of material increasing the moisture-absorbing capabilities of the perspiration headband.

8. A perspiration band for headgear, comprising:

a flexible body formed from moisture-absorbing material, said body having a first side, a second side and opposing end portions connecting the first side and the second side, said first side being provided with a pair of cutouts dividing the first side into a plurality of tabs, and wherein said end portions are integrally connected at an obtuse angle in relation to said second side; and a plurality of securing members attached along said first side and said second side, said securing members being fastened together when said flexible body is positioned on a headband of the headgear, and wherein an excess of material is formed along the second side when said securing members are fastened together on the headband of the headgear, said excess of material increasing the moisture-absorbing capabilities of the perspiration headband.

9. The device of claim 8, wherein said plurality of tabs comprises a first side tab, a central tab and a second side tab, and wherein a securing member is attached in each corner of said first side tab, said central tab and said second side tab.

10. The device of claim 9, wherein securing members positioned along the first side of the central tab have generally aligned mating securing members positioned along the second side, and wherein securing members of the first side tab and the second side tab are non-aligned in relation to mating securing members secured along the second side of the body.

11. The device of claim 8, wherein said cutouts have a generally V-shaped configuration.

12. The device of claim 8, wherein the first side has longitudinal dimensions greater than longitudinal dimensions of the second side.

13. The device of claim 8, wherein said securing members are snaps provided with mating engaging fastener elements facing an inner surface of the body.

14. A method of making a perspiration band, comprising the steps of:

providing a flexible body formed from a moisture-absorbing material, said body being provided with a pair of integrally-connected mirror-image first portion and second portion, each first portion and second portion having a first side formed with a pair of cutouts that create a plurality of tabs along the first side of each portion;

hemming end parts of each of said portions;

folding said body in half so that an inner face of the first portion overlays an inner face of the second portion and a line of connection between the first portion and the second portion defines a second side of the body;

securing the first side of the first portion to the first side of the second portion and turning the body inside out, thereby forming a single first side of the body;

securing end parts of the body; and attaching securing members along the first side and the second side of the body.

15. The method of claim 14, wherein said cutouts have a generally V-shaped configuration.

16. The method of claim 14, wherein an excess of material is formed along the second side when said securing members are fastened together on the headband of the headgear, said excess of material increasing the moisture-absorbing capabilities of the perspiration headband.

17. The method of claim 14, wherein said plurality of tabs comprises a first side tab, a central tab and a second side tab, and wherein a securing member is attached in each corner of said first side tab, said central tab and said second side tab, said securing members positioned along the first side of the central tab have generally aligned mating securing members positioned along the second side, and wherein securing members of the first side tab and the second side tab are non-aligned in relation to mating securing members secured along the second side of the body.

18. The method of claim 14, wherein the first side has longitudinal dimensions greater than longitudinal dimensions of the second side and said end parts extend at an obtuse angle in relation to said first side.

19. The method of claim 14, wherein said securing members are snaps provided with mating engaging fastener elements facing one face of the body.

20. A perspiration band for headgear, comprising:

a flexible body formed from moisture-absorbing material, said body having a first side, a second side and opposing end portions connecting the first side and the second side, said first side being provided with a pair of cutouts dividing the first side into a first tab, a central tab and a second tab, and wherein said end portions are integrally connected at an obtuse. angle in relation to said second side, said first side having longitudinal dimensions sufficiently greater than longitudinal dimensions of said second side so as to form moisture absorbing folds when said perspiration band is positioned on the headgear; and a plurality of securing members attached at corners of each of said tabs and a corresponding number of securing members being attached along said second side, securing members of said first tab being non-aligned with opposing securing members of said second side, securing members of said central tab being aligned with opposing securing members of said second side, and securing members of said second tab being non-aligned with opposing securing members of said second side, said securing members being fastened together when said flexible body is positioned on a headband of the headgear.

21. The device of claim 20, wherein said moisture absorbing folds increase the moisture-absorbing capabilities of the perspiration headband.

22. The device of claim 20, wherein said cutouts have a generally V-shaped configuration.

* * * * *